United States Patent [19]

Metz

[11] 4,347,019

[45] Aug. 31, 1982

[54] COMPOSITE COMPLEX PROFILE AND THE PROCESS FOR ITS MANUFACTURING

[75] Inventor: Paul Metz, Luxembourg, Luxembourg

[73] Assignee: Arbed S.A., Luxembourg, Luxembourg

[21] Appl. No.: 177,592

[22] Filed: Aug. 13, 1980

[30] Foreign Application Priority Data

Aug. 14, 1979 [LU] Luxembourg ..... 81607

[51] Int. Cl.[3] ..... E04C 3/34

[52] U.S. Cl. ..... 405/255; 52/724; 52/727; 405/257

[58] Field of Search ..... 405/257, 254, 256, 255, 405/227; 52/727, 724, 170, 728

[56] References Cited

U.S. PATENT DOCUMENTS

| | | | |
|---|---|---|---|
| 2,846,327 | 8/1958 | Wood | 106/97 |
| 3,050,161 | 8/1962 | Shlager | 52/727 |
| 3,071,481 | 1/1963 | Beach | 106/97 |
| 3,603,052 | 9/1971 | Novoa | 52/727 |
| 3,798,867 | 3/1974 | Starling | 52/724 |
| 3,890,795 | 6/1975 | Maurer | 52/724 |
| 4,019,301 | 4/1977 | Fox | 52/727 |

*Primary Examiner*—John E. Murtagh
*Attorney, Agent, or Firm*—Karl F. Ross

[57] ABSTRACT

A composite beam especially for pile driving comprises an H-beam core whose flanges are bridged by steel sheets having inwardly bent edges engaging over outwardly projecting spurs on the flange edges. The web of the H-beam thus defines with the sheets two compartments which are internally lined with colloidal concrete, the outer steel surfaces being likewise coated with colloidal concrete.

6 Claims, 5 Drawing Figures

COMPOSITE COMPLEX PROFILE AND THE PROCESS FOR ITS MANUFACTURING

FIELD OF THE INVENTION

This invention relates to a composite complex profile of steel and concrete.

BACKGROUND OF THE INVENTION

Composite profiles of steel have been known for a long time. Those profiles can make up assemblages of girders by themselves or with flat or contoured elements. The composite profiles can serve as as posts or as other elements in construction waterway equipment, maritime gates, embankments or dikes.

Composite profiles of steel may also be used for the construction of buildings.

For utilization in the form of posts, composite profiles are needed which have not only with a large friction surface, but also an elasticity and rigidity sufficient for pile driving and the stress exercised on it, after the posts are put into service. Moreover, when used as supporting elements in buildings, for example, the composite profiles must be resistant to corrosion, must possess satisfactory supporting power and must be fire-resistant.

In order to render the profiles resistant to corrosion, whatever the ultimate use may be, the elements can be galvanized or otherwise metallized or coats of paint are applied. All these processes require preliminary cleaning of the metallic surfaces by way of scraping or by sand or shot blasting at considerable expenses for equipment and personnel.

One possibility for the making of composite profiles lies in assembling H-form girders from flat or contoured side elements by welding the wings or by joining them with the aid of hooks and spurs, with which the flats or contoured are respectively provided. These junctions are formed by an engaging double hook and the spurs of the wings with which the flats and side contoured are respectively supplied. The seams formed by the interengagement of the hooks and spurs nevertheless, need welding, especially when used as posts for pile driving.

It is known that composite profiles which are used as supporting elements in the construction of buildings, can be furnished with a concrete filling, which confers upon them an increased resistance to fire and increases their supporting force. On the other hand, welding lateral sheets to the wings of the girders which is done with a minute care, assures a rigorous water-tightness. When the profile is filled with water It will have an unequalled resistance against fire. Besides, in order to reduce the pressures which exist in the interior of the sections filled with water, separate circuits of small heights have to be envisaged. This method is a very difficult one. In any event, the cooling of composite profiles, which serve as element of support, with water is hardly practiced.

Another difficulty which arises in the course of using composite profiles is that the geometrical tolerance increases during production of the girders, the flats or contoured lateral members and the junctions; and generally, greater efforts are needed for assembling the elements which form the composite profile in series production. This is especially true in the case of long elements.

OBJECT OF THE INVENTION

The object of the invention is to provide a composite profile which, on the one hand, is applicable as a post or as an element of construction in buildings, and which, on the other hand, is free of the above described disadvantages.

SUMMARY OF THE INVENTION

This object is achieved with a complex composite profile of steel and concrete. It comprises a steel H-formed girder, with the ends of the wings having spurs and bridget by steel sheets on both sides of the girder web. The edges of the sheets are bent in a manner so as to embrace the aforesaid spurs. The profile is additionally characterized by the fact that the internal and external free surfaces of steel carry a colloidal concrete coating.

Thanks to the simple bending of the ends of the lateral sheets which is easily realized through hot or cold rolling, the difficulties presented by a certain deviation of the geometry of the girder wings are not as severe as in the case in which hooks are used. This is all the more true where hooks and separate joining members are used, for they are in effect not only elements which increase the production cost of the profile, but also add an element of uncertainty.

According to the invention the lateral sheets can have an outwardly convex rounded or angular form.

The bent edges of the sheets which envelope the spurs situated on the ends of the girder's wings, may be welded to the wings, without the employment of special means for assemblage or for keeping them in place.

According to the invention, the hollows circumscribed by the web and the wings of the girder, as well as by the sheets, can be filled with concrete. The filling increases the profile bearing force and protection against fire.

According to the invention all the free metallic surfaces are covered with colloidal concrete. It has been demonstrated that colloidal concrete has a remarkable adhesion power for steel, and that the steel covered with colloidal concrete is able to resist heavy mechanical demands encountered in the course of pile driving the profiles made according to the invention, when they are used as posts. It is sometimes useful to furnish an end of the post with a conical or pyramidal formed shoe, whose edges extend beyond the outer contour of the composite profile. This facilitates pile driving by elimination of friction and prevents damaging the coating during the pile driving of the post.

The adherence of the colloidal concrete to the steel, as well its extremely compact consistency, imparts to the assembly a good tightness, and an effective protection against corrosion by water. Thus, it is possible according to the execution of one form of the invention, to fill with water the empty spaces circumscribed by the web and wings of the girder, as well as by the sheets.

This form of execution permits the use of the profile, according to the invention as a bearing element in the construction of buildings, It is also the best protection against fire, thanks to the presence of water; and, the tightness brought about by the application of colloidal concrete to the exterior and eventually, to the interior of the profile, prevents any risk of water leakage.

Another advantage is offered by the simplicity of the manufacturing process of the composite complex profile, according to the invention. This process is characterized by the fact that the wings of the spur-provided girder, are joined with two sheets whose edges are bent, by sliding the sheets along the wings so that the bent edges cover the spurs of the wings. Each sheet is then welded, at least partially, to the wings of the girder. The exterior of the profile is then covered with a coating of colloidal concrete and its cavities are filled with concrete.

In the case of its use as a bearing element in building construction, if the occasion should arise, a filling with water, rather than concrete, can be provided, especially in the case where duration of the resistance to fire is the predominant factor. Such is the case, for example, in hospitals, old age homes, etc.

A feature of the invention is that the coating with colloidal concrete can be done directly on the surfaces of the steel. These surfaces can remain in a rough state of lamination.

This totally prevents the labor-consuming operation of cleaning of the surface, which is a preponderant factor in the production cost of the classical composite profiles. Tests have demonstrated that the adhesive power of colloidal concrete to steel surfaces in a rough state is at least equivalent to the adhesive power to steel surfaces treated by sand or shot blasting.

SPECIFIC DESCRIPTION

Figure 1:
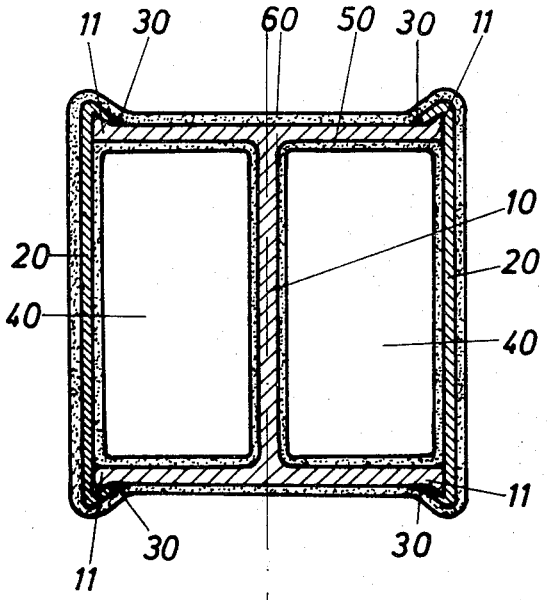
FIG. 1 is a cross section of a profile.
Figure 3:
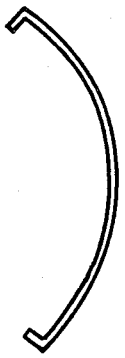
FIGS. 3–4 show the sections of different geometrics of the lateral sheets which can join the wings of the central girder.
Figure 4:
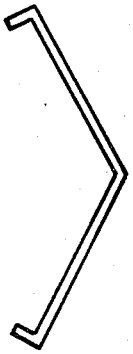
Figure 5:
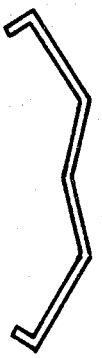

In FIG. 1 the central girder 10 is shown to have a configuration which the ends of the wings have spurs 11. These spurs 11 are enveloped by the bends which are formed on the sheets 20 at their ends. These sheets 20 can equally present rounded forms as in FIG. 3; or angular forms according to FIG. 4; and even polygonal ones, as in FIG. 5.

The profile represented in FIG. 1 has, in addition, an interior coating of colloidal concrete 50 and a similar exterior coating 60 which equally covers the weld seam 30 where the sheets are fixed to the wings of the girder 10. The resistance to fire and the bearing force of the profile are increased, thanks to its filling with concrete 40. Naturally, in this case, no interior coating with colloidal concrete is applied.

Figure 2:
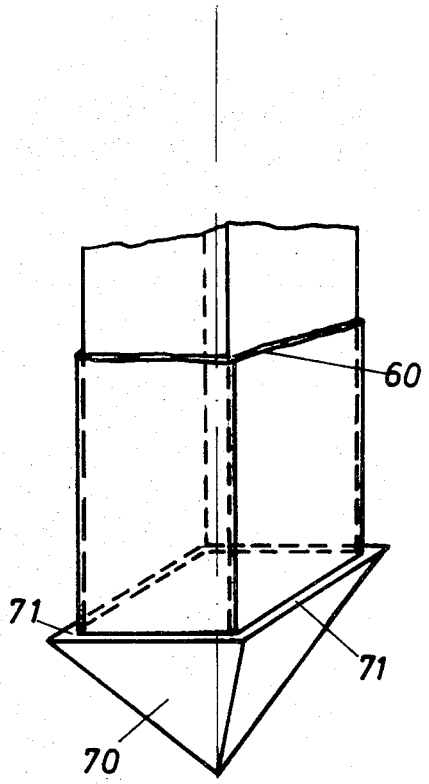
FIG. 2 is an elevational view which depicts the end of the profile tapering to a point.

FIG. 2 presents a form of execution as a post, with a conspicuous pyramidal shoe 70 welded to one end of the profile in a manner in which the exterior coating 60 of colloidal concrete will be protected by the edges 71 which extend beyond the exterior contour of the composite profile.

I claim:

1. A post comprising:

a steel H-beam core formed with a central web and lateral flanges unitary with said web, each of said flanges being formed with an outwardly turned spur along the outer edge of an outer face thereof;

a pair of steel sheets each having inwardly bent edges, each of said sheets bridging two spaced-apart flanges of said H-beam with the inwardly bent edges of said sheets form-fittingly engaged over the spurs of said flanges, said sheets lying parallel to said web and defining a pair of compartments with said web and inner surfaces of said flanges;

an outer layer of colloidal concrete bonded directly to the steel of said sheets and said flanges and completely enveloping same; and inner layers of colloidal concrete bonded directly to surfaces of said flanges and said sheets defining said compartments and thereby lining same.

2. The post defined in claim 1, further comprising a pointed pyramidal shoe fitted onto an end thereof and extending beyond said outer layer to facilitate pile driving of said post.

3. The post defined in claim 1 wherein said steel sheets are outwardly convex.

4. The post defined in claim 3 wherein said steel sheets are curved in cross section.

5. The post defined in claim 3 wherein said steel sheets are angularly bent in cross section.

6. The post defined in claim 1, claim 2, claim 3, claim 4 or claim 5, further comprising welds between each bent edge of a respective sheet and a respective flanges of said H-beam.

* * * * *